US008742194B2

(12) United States Patent
Mapp, Sr. et al.

(10) Patent No.: US 8,742,194 B2
(45) Date of Patent: Jun. 3, 2014

(54) HYDROCARBON-CONTAINING MIXTURE AND METHOD AND SYSTEM FOR MAKING THE SAME

(75) Inventors: Douglas O. Mapp, Sr., Melbourne, FL (US); Douglas O. Mapp, II, Maryville, TN (US)

(73) Assignee: CM Global Systems, LLC, Melbourne, FL (US)

( * ) Notice: Subject to any disclaimer, the term of this patent is extended or adjusted under 35 U.S.C. 154(b) by 45 days.

(21) Appl. No.: 13/476,702

(22) Filed: May 21, 2012

(65) Prior Publication Data

US 2013/0305597 A1 Nov. 21, 2013

(51) Int. Cl.
*C07C 7/20* (2006.01)
*C07C 2/02* (2006.01)

(52) U.S. Cl.
USPC ..... 585/534; 585/1; 585/505; 585/16; 422/129

(58) Field of Classification Search
USPC ..... 422/1, 6, 14, 534, 129; 585/1, 16, 505, 585/534
See application file for complete search history.

(56) References Cited

U.S. PATENT DOCUMENTS 2,811,431 A * 10/1957 Zwicky et al. ..... 149/1
3,325,557 A * 6/1967 Schwarzberg ..... 585/3
4,054,423 A 10/1977 Blenman
4,066,713 A * 1/1978 Faraci et al. ..... 585/811
7,141,711 B2 11/2006 Van Egmond et al.
7,192,987 B2 3/2007 Van Egmond et al.
7,332,636 B2 2/2008 Xu et al.
7,700,816 B2 4/2010 Xu et al.
7,781,490 B2 8/2010 Lattner et al.
2004/0085022 A1* 5/2004 Kosaka et al. ..... 313/582
2010/0016646 A1* 1/2010 Koenigsmann et al. ..... 585/259
2010/0319536 A1 12/2010 Song et al.

FOREIGN PATENT DOCUMENTS

JP 50069001 A * 6/1975

OTHER PUBLICATIONS

Leeds et at., "Acetylene—The Principles of Its Generation and Use", Second Edition, pp. 1-8 and 136-150.
Sontag, "Purification, Drying and Product Quality Control of Acetylene", Reports on Science and Technology 38/1984; pp. 42-49.

* cited by examiner

*Primary Examiner* — Pamela H Weiss
(74) *Attorney, Agent, or Firm* — Duane Morris LLP; Gregory M. Lefkowitz

(57) ABSTRACT

A hydrocarbon-containing mixture including acetylene and butenyne is disclosed. The hydrocarbon-containing mixture can include 10% to 89% acetylene, 10% to 89% butenyne, and at least 0.25% dimethyl butadiyne. A method and system for producing the hydrocarbon-containing mixture is also disclosed. The system can include an acetylene production subsystem comprising at least one vessel and an acetylene output for delivering acetylene to a finishing vessel via a finishing vessel inlet. The finishing vessel can include a diffuser in fluid communication with the finishing vessel inlet, and gas exiting the diffuser can pass through a reaction chamber filled with solid calcium carbide before passing through a finishing vessel outlet.

17 Claims, 5 Drawing Sheets

HYDROCARBON-CONTAINING MIXTURE AND METHOD AND SYSTEM FOR MAKING THE SAME

FIELD OF THE DISCLOSURE

The present disclosure relates generally to a high-energy, acetylene-based fuel and a method and system for making the same.

BACKGROUND

Natural gas is used as a fuel source in a wide range of applications, from gas grills and stoves to water heaters. However, like oil, natural gas is a resource that will one day be depleted. Thus, there are efforts to find substitutes for natural gas. Acetylene has been used in some high energy applications, such as torches and welding.

However, to date, safety concerns have prevented widespread adoption of acetylene. In particular, acetylene gas produced by conventional processes will explode when exposed to pressures above 15 psig. To avoid this issue, acetylene is generally shipped and stored dissolved in a solvent (e.g., acetone) within a metal cylinder with a porous filling (e.g., Agamassan), which generally renders it safe to transport and use, given proper handling. These measures add expense and prevent acetylene from being a useful alternative to natural gas. Thus, the need for alternatives to natural gas persist.

SUMMARY OF THE INVENTION

A hydrocarbon-containing mixture that includes acetylene and butenyne is disclosed. The hydrocarbon-containing mixture can include 10% to 89% acetylene, 10% to 89% butenyne, and at least 0.25% dimethyl butadiyne. The butenyne-to-acetylene ratio can be at least 0.5:1. The hydrocarbon-containing mixture can include at least 20% butenyne. The hydrocarbon-containing mixture can also include at least 1% divinyl sulfide, at least 1% nitrogen, or both.

An energy content of the hydrocarbon-containing mixture can be at least 1,100 BTU/ft$^3$ at standard temperature and pressure. The hydrocarbon-containing mixture can be present in liquid form. The hydrocarbon-containing mixture can be stable at a pressure of 25 psig for more than 1 day.

A method for producing the hydrocarbon-containing mixtures presented herein is also described. The method can include providing a feed stream comprising acetylene; and reacting the feed stream with solid calcium carbide ($CaC_2$) to produce a hydrocarbon-containing mixture comprising acetylene and butenyne. The hydrocarbon-containing mixture can (i) also include dimethyl butadiyne, (ii) include at least 10% butenyne, or (iii) both.

The reacting step can include reacting the feed stream with particulate calcium carbide. The pressure of the feed stream during the reacting step can be at least 15 psig, at least 18 psig, at least 20 psig, at least 22 psig, or at least 25 psig.

The reacting step can be of sufficient duration that the hydrocarbon-containing mixture stream comprises 10% to 89% acetylene, 10% to 89% butenyne, and at least 1% dimethyl butadiyne. The reacting step can be of sufficient duration that a butenyne-to-acetylene ratio of the hydrocarbon-containing mixture stream is at least 0.5:1. The reacting step can be of sufficient duration that the hydrocarbon-containing mixture stream comprises at least 20% butenyne.

A system for producing the hydrocarbon-containing mixture described herein is also described. The system can include an acetylene production subsystem comprising at least one vessel and an acetylene feed pipe for delivering acetylene to a diffuser. The finishing vessel can be in fluid communication with the diffuser, which is also in fluid communication with the acetylene feed pipe. Gas exiting the diffuser passes through a reaction chamber filled with solid calcium carbide then passes through a finishing vessel outlet. The diameter of the finishing vessel outlet can be less than the diameter of the finishing vessel inlet and/or acetylene feed pipe.

The finishing vessel can include an outer housing, and the diffuser can be in fluid communication with, and inside of, the outer housing. The reaction chamber can include space between the diffuser and the outer housing.

These and other features, objects and advantages of the present method and system will become more apparent to one skilled in the art from the following description and claims when read in light of the accompanying drawings.

Figure 1:
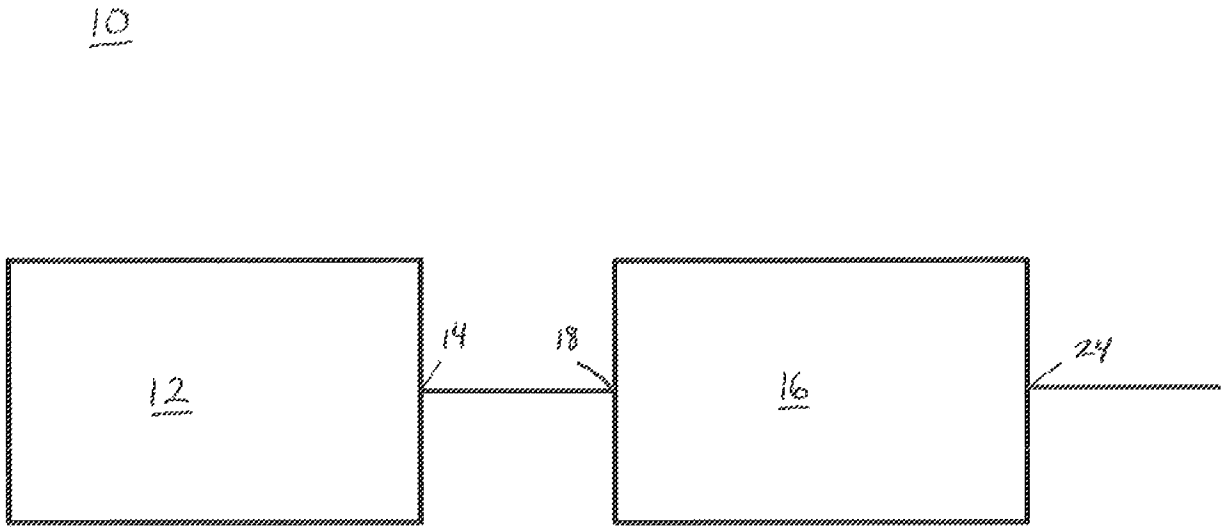
FIG. 1 is a simplified schematic showing a system as described herein.

It should be noted that the Figures are not drawn to scale.

DETAILED DESCRIPTION

A hydrocarbon-containing mixture comprising acetylene and butenyne is described. The hydrocarbon-containing mixture described herein is stable at pressures at or above 15 psig for prolonged periods of time. This is a substantial difference from conventional acetylene gas, which will explode at pressures above 15 psig. This unique property allows the hydrocarbon-containing mixture to be (i) stored in liquid form without dissolving it in a solvent, and (ii) transported, stored and used in conventional tanks without the porous media currently necessary for acetylene gas. This enables the hydrocarbon-containing mixture to be used in a much wider range of applications while maintaining a high energy content.

The hydrocarbon-containing mixture can be made using a feed stream comprising acetylene. For instance, the feed stream can be produced using the well-known reaction between water and calcium carbide ($CaC_2$). The feed stream can then be processed further in a finishing vessel in order to produce butenyne (also vinylacetylene) and, optionally, dimethyl butadiyne (also dimethyl diacetylene). In some instances, the hydrocarbon-containing mixture can also include additional molecules resulting from contaminants or by-products in the process. For example, additional hydrocarbons may be present, with or without heteroatoms, divinyl sulfide may be present from contaminants in the calcium carbide and nitrogen ($N_2$) may be present from the atmosphere. The relevant compounds have the following chemical structures:

Acetylene = H—C≡C—H

Butenyne =

Dimethyl butadiyne = $H_3C—C≡C—C≡C—CH_3$

Divinyl sulfide =

As used herein, "hydrocarbon-containing mixture" is intended to refer to a mixture that includes hydrocarbons, such as acetylene, butenyne and dimethyl butadiyne, as well as, heteroatom containing organic compounds (e.g., divinyl sulfide) and other gases (e.g., nitrogen and water vapor). The hydrocarbon-containing mixture can be substantially free of aromatic compounds. The hydrocarbon-containing mixture can be substantially free of compounds with a molecular weight greater than 150 Da, free of compounds with a molecular weight greater than 100 Da, or free of compounds with a molecular weight greater than 90 Da. The hydrocarbon-containing mixture can be substantially free of alkanes (i.e., the hydrocarbons present are alkenes and alkynes). As used herein, "substantially free" indicates an abundance of 3% or less, 2% or less, 1% or less, or 0.5% of less.

The finishing vessel is designed to facilitate the dimerization of acetylene to butenyne. The further reaction of butenyne with acetylene also produces dimethyl butadiyne. Unexpectedly, the hydrocarbon-containing mixture exiting the finishing vessel is stable for prolonged periods under higher pressures, e.g., above 20 psig.

The hydrocarbon-containing mixture can include 10% to 89% acetylene, 10% to 89% butenyne and, optionally, at least 0.25% dimethyl butadiyne. The acetylene can be present in an amount greater than 15%, greater than 20%, greater than 25%, greater than 27.5%, greater than 30%, or greater than 32.5%. The acetylene can be present in an amount less than 85%, less than 80%, less than 75%, less than 70%, less than 65%, less than 60%, less than 55%, less than 50%, less than 45% or less than 40%. Where all percentages are mole percentages based on the entire mixture, including heteroatom containing molecules (e.g., divinyl sulfide and nitrogen).

The butenyne can be present in an amount greater than 15%, greater than 20%, greater than 25%, greater than 30%, greater than 35%, greater than 40%, greater than 42.5%, greater than 45% or greater than 47.5%. The butenyne can be present in an amount less than 85%, less than 80%, less than 75%, less than 70%, less than 65%, less than 60%, or less than 55%.

The dimethyl butadiyne can be present in an amount greater than 0.25%, greater than 0.5%, greater than 0.75%, greater than 1%, or greater than 1.25%. The dimethyl butadiyne can be present in an amount less than 50%, less than 40%, less than 30%, less than 20%, less than 10%, less than 5% or less than 2.5%.

The divinyl sulfide can be present in an amount greater than 0.5%, greater than 2.5%, greater than 5%, or greater than 10%. The divinyl sulfide can be present in an amount less than 50%, less than 40%, less than 30%, less than 20%, less than 15%, less than 10%, or less than 5%.

Nitrogen can also be present in the hydrocarbon-containing mixture. The nitrogen can be present in an amount greater than 0.25%, greater than 0.5%, greater than 0.75%, greater than 1%, or greater than 1.25%. The nitrogen can be present in an amount less than 50%, less than 40%, less than 30%, less than 20%, less than 10%, less than 5% or less than 2.5%.

The ratio of butenyne-to-acetylene can be at least 0.5:1, at least 0.75:1, at least 1:1, at least 1.1:1, at least 1.2:1, at least 1.3:1 or least 1.4:1. The ratio of butenyne-to-acetylene can be less than 4:1, less than 3:1, less than 2.5:1, less than 2:1, or less than 1.75:1. The ratios calculated herein are based on mole ratios.

The hydrocarbon-containing mixture can be anhydrous. As used herein, the term "anhydrous" can mean no detectible amounts of water, but can also include less than 1% water, less than 0.5% water, less than 0.1% water, less than 0.01% water, less than 0.001% water or less than 0.0001% water, based on mole percentages.

The energy content of the hydrocarbon-containing mixture can be at least 1,100 BTU/$ft^3$ at standard temperature and pressure. This energy release compares favorably with natural gas, but is an improvement because it can be formed in situ rather than being a natural resource that is extracted from the ground.

As mentioned above, even in the absence of oxygen, acetylene gas produced by conventional methods can explode with devastating results when exposed to pressures above 15 psig. Thus, numerous precautions must be taken and specialized equipment is required when handling conventional acetylene gas. In contrast, the hydrocarbon-containing mixtures described herein remains stable even at pressures above 20 psig, 25 psig, 30 psig, 35 psig or even 40 psig, and even when left at these elevated pressures for at least 1 hour, at least 6 hours, at least 12 hours, at least one day, at least one week, or at least one month. As used herein, a "stable" hydrocarbon-containing mixture will not explode when exposed to elevated pressures for extended periods of time.

The hydrocarbon-containing mixture described herein can also be present in a liquid form. Because liquification of light weight hydrocarbons generally occurs at high pressure, this is only possible because the hydrocarbon-containing mixtures described herein are unexpectedly stable at high pressures. The liquid hydrocarbon-containing mixture can be free of solvents (e.g., acetone and dimethylformamide), can be stored in a hollow vessel (i.e., a vessel without a porous matrix—such as Agamassan—disposed therein), or both.

As shown in FIGS. 1-5, a system 10 for producing the hydrocarbon-containing mixture described herein is also described. The system 10 can include an acetylene production subsystem 12 comprising at least one vessel and an acetylene output 14 for delivering acetylene to a diffuser 20 via an acetylene feed pipe 19. Where the diffuser 20 is positioned within the finishing vessel 16, the acetylene feed pipe 19 can be coupled to a finishing vessel inlet 18. The finishing vessel 16 can include a diffuser 20 in fluid communication with the reaction chamber 22. The acetylene exiting the diffuser 20 can pass into a reaction chamber 22 filled with solid calcium carbide 24 then through a finishing vessel outlet 26 as the product stream 42. The finishing vessel outlet 26 can have a diameter less than a diameter of the finishing vessel inlet 18 and/or the acetylene feed pipe 19.

The acetylene production subsystem 12 can be any subsystem for producing acetylene gas. Acetylene gas can be produced via the well-known reaction of water with calcium carbide ($CaC_2$). However, the resulting acetylene is known to be extremely explosive at pressures above 15 psig.

An exemplary acetylene production subsystem is shown in U.S. Pat. No. 4,054,423 issued to Blenman, which is incorporated herein by reference. The outlet 114 of Blenman can function as the acetylene outlet in the system described herein.

Figure 2:
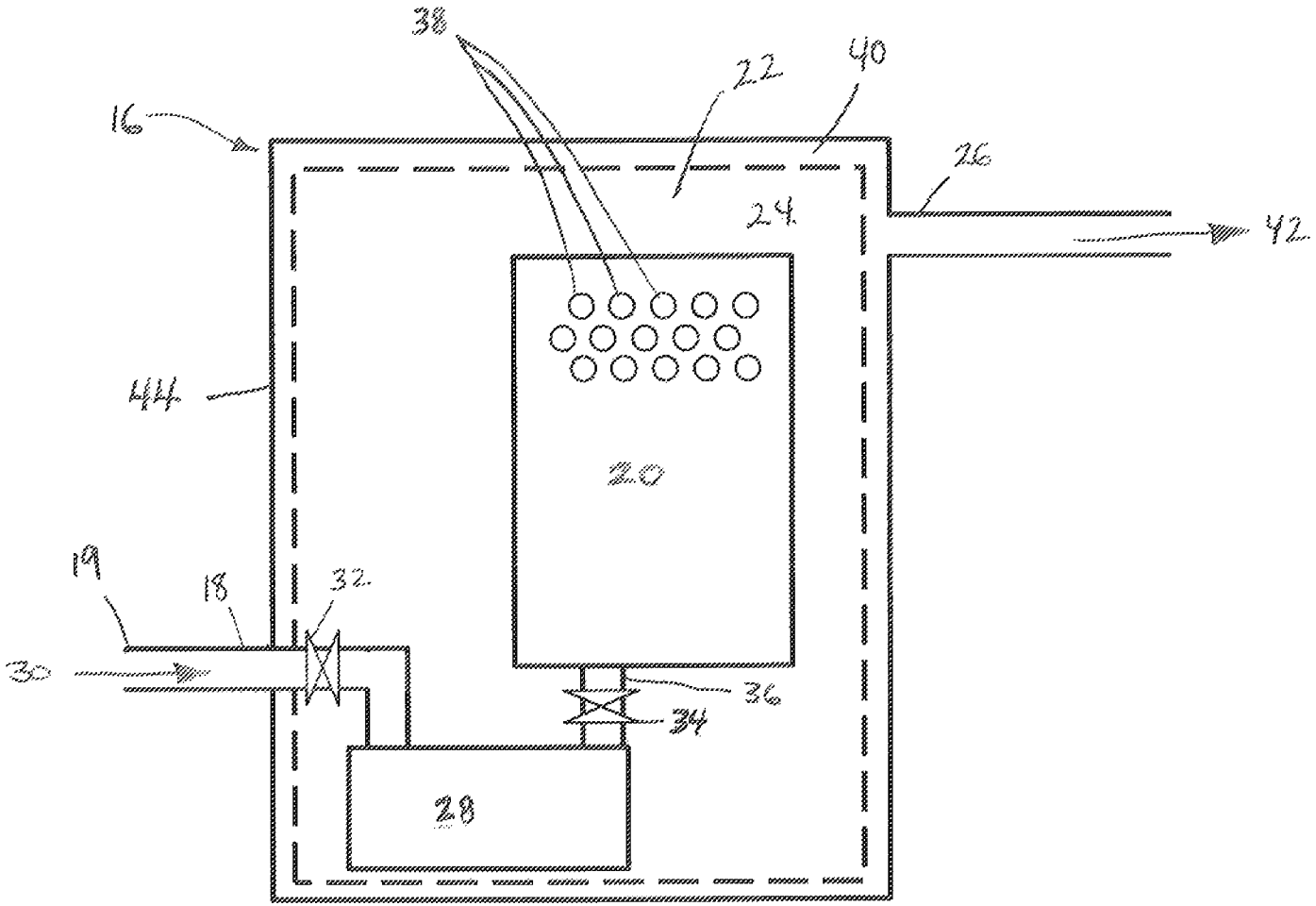
FIG. 2 is a cross-section view of a finishing vessel as described herein.

As shown in FIG. 2, the finishing vessel inlet 18 can be in fluid communication with a water trap 28. The acetylene feed stream 30 can flow through a one-way valve 32 prior to entering the water trap 28. The water trap 28 and the diffuser 20 can be in fluid communication, e.g., via pipe 36, and gas passing from the water trap 28 to the diffuser 20 can pass through a second one-way valve 34. The one-way valves 32, 34 can be adapted to prevent the acetylene feed 30 from flowing backward (i.e., away from the diffuser 20).

As shown in FIGS. 2-5, the diffuser 20 can be a hallow vessel that includes at least one orifice 38 in the exterior thereof. The interior of the diffuser 20 can be in fluid communication with the reaction chamber 22 via the at least one orifice 38. The at least one orifice 38 can be a plurality of orifices 38. As shown in FIGS. 2-5, the orifice(s) 38 can be positioned on an upper portion of the diffuser 20.

The reaction chamber 22 can be filled with solid calcium carbide 24. The solid calcium carbide 24 can be in the form of granules or particles. An average diameter of the granules or particles can be 1.25 cm or less. The entire space within the outer housing 44 in fluid communication with the finishing vessel outlet 26 and the interior of the diffuser 20 can be filled with the solid calcium carbide 24.

A filter media 40 can be positioned between the solid calcium carbide 24 and the finishing vessel outlet 26. The filter media 40 can be a filter media adapted to prevent particulate, such as the solid calcium carbide 24, from being entrained in the product stream 42 exiting the finishing vessel outlet 26. The filter media 40 can be selected from filter media including, but not limited to, textiles, woven materials, non-wovens. The filter media can be any material including, but not limited to, polyesters, cellulosic materials, cotton, nylon, and mixtures thereof.

The diameter of the orifices 38 can be smaller than the diameter of the acetylene feed pipe 19. The diameter of the orifices 38 can be at least 10% smaller than the diameter of the acetylene feed pipe 19, or at least 15% smaller than the diameter of the acetylene feed pipe 19, or at least 20% smaller than the diameter of the acetylene feed pipe 19, or at least 25% smaller than the diameter of the acetylene feed pipe 19, or at least 30% smaller than the diameter of the acetylene feed pipe 19.

Similarly, the diameter of the finishing vessel outlet 26 can be smaller than the diameter of the acetylene feed pipe 19. The diameter of the finishing vessel outlet 26 can be at least 10% smaller than the diameter of the acetylene feed pipe 19, or at least 15% smaller than the diameter of the acetylene feed pipe 19, or at least 20% smaller than the diameter of the acetylene feed pipe 19, or at least 25% smaller than the diameter of the acetylene feed pipe 19, or at least 30% smaller than the diameter of the acetylene feed pipe 19.

The finishing vessel inlet 18 and the acetylene feed pipe 19 can have substantially the same diameter. The orifice (38) and the finishing vessel outlet 26 can have substantially the same diameter.

Although not necessary for practicing the invention, it is believed that the sizing of the pipes and orifices increases the rate of the reaction that converts acetylene to butenyne and, subsequently, dimethyl butadiyne. This may be the result of one or more of the following factors: increased residence time, increased pressure, and increased interaction with the solid calcium carbide or with neighboring molecules.

Figure 3:
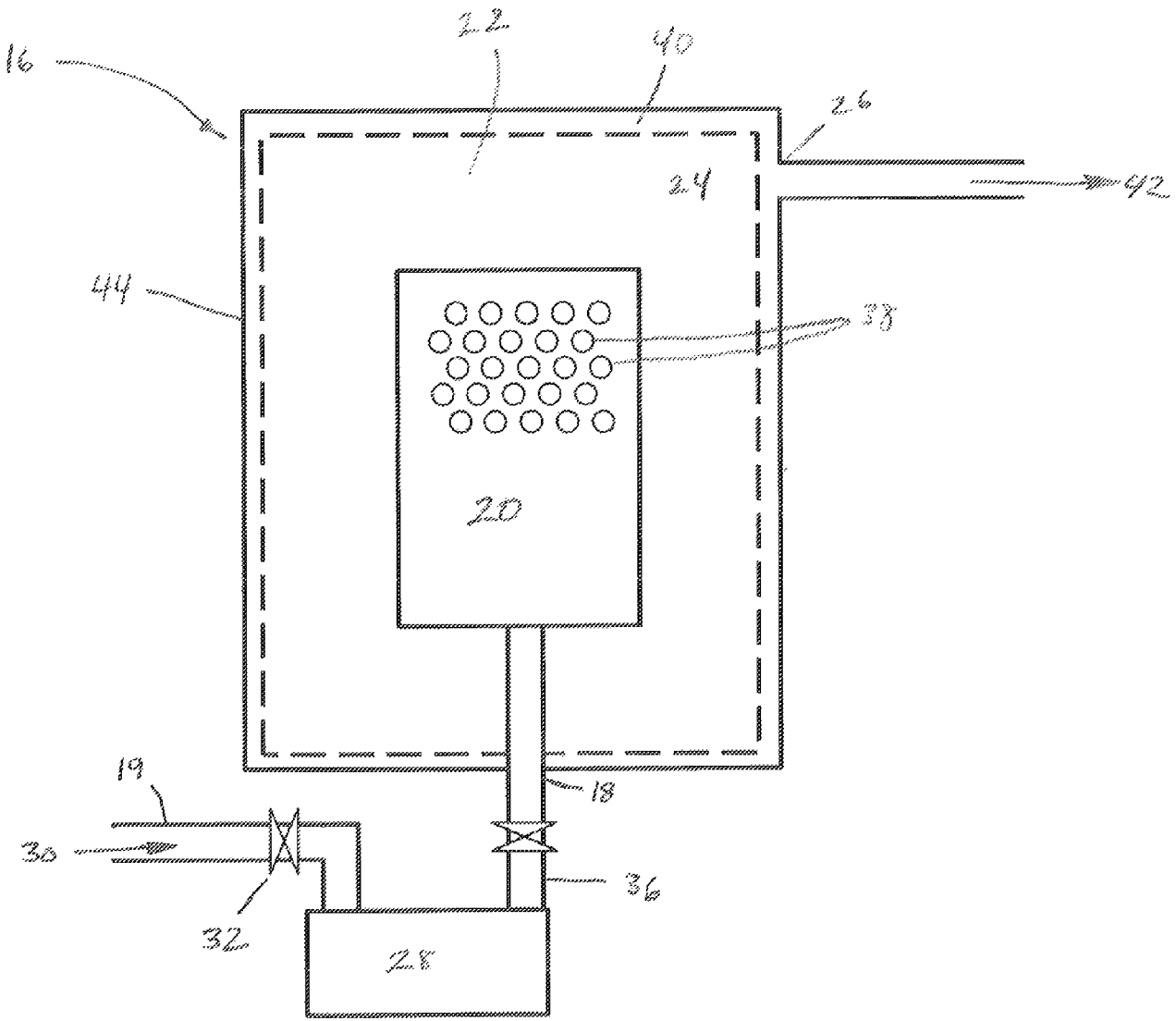
FIG. 3 is a cross-section view of another finishing vessel as described herein.
Figure 5:
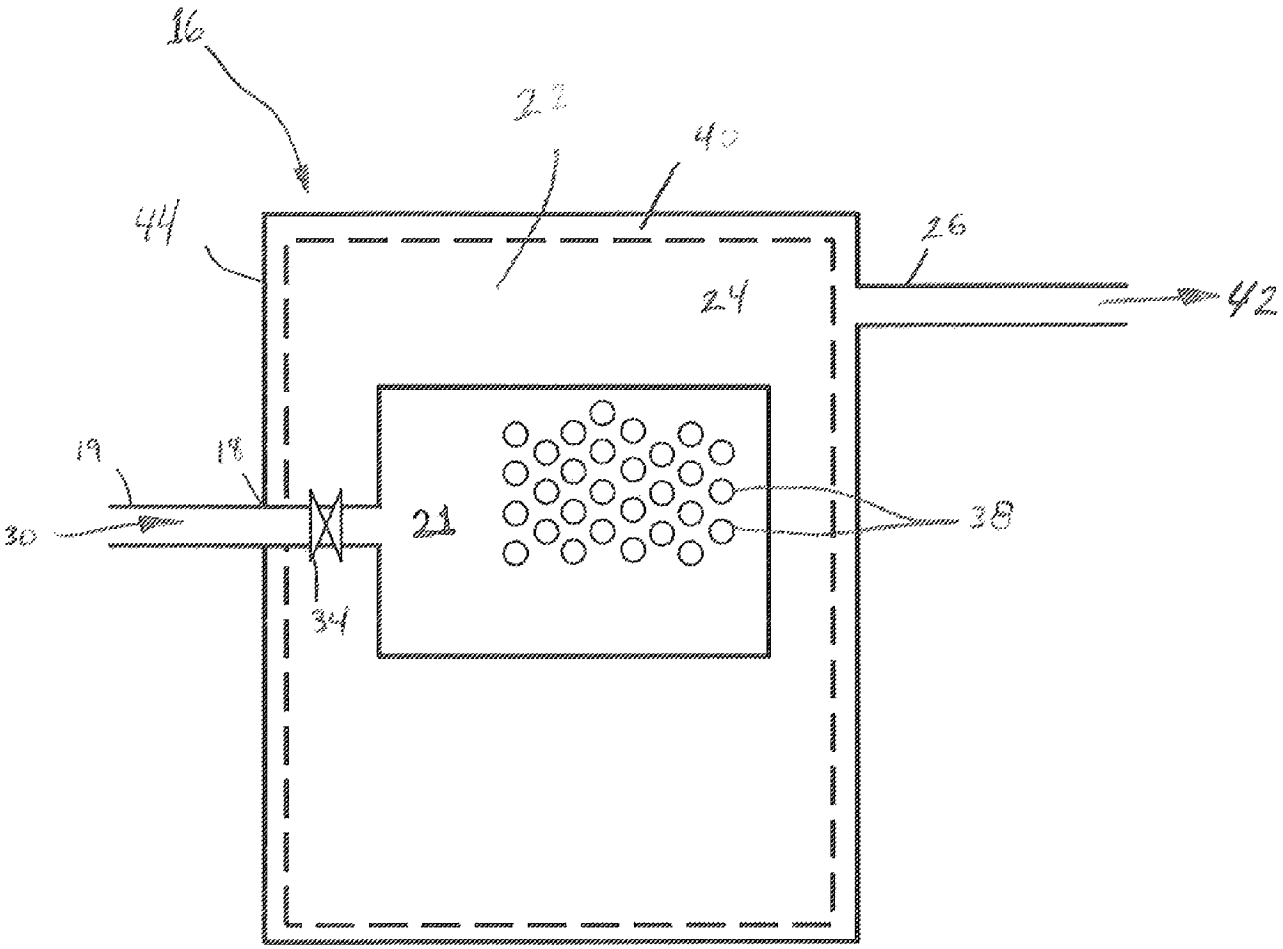
FIG. 5 is a cross-section view of another finishing vessel as described herein.

The finishing vessel 16 can include an outer housing 44 and the diffuser 20 can be in fluid communication with, and positioned inside of, the outer housing 44. As shown in FIGS. 2, 3 and 5, the reaction chamber 22 can comprise the free space between the diffuser 20 and the outer housing 44.

As shown in FIG. 3, the water trap 28 and one-way valves 32, 34 can be external to the finishing vessel 16. This allows for simplified maintenance of the finishing vessel 16 and the associated water trap 28 and one-way valves 32, 34. In this instance the acetylene feed 30 can flow in feed pipe 19 through a one-way valve 32 and into the water trap 28. The acetylene feed 30 can then flow in pipe 36 through a second one-way valve 34 into the diffuser 20. The calcium carbide 24 and filter media 40 are substantially the same in the designs described in FIGS. 2-5.

Figure 4:
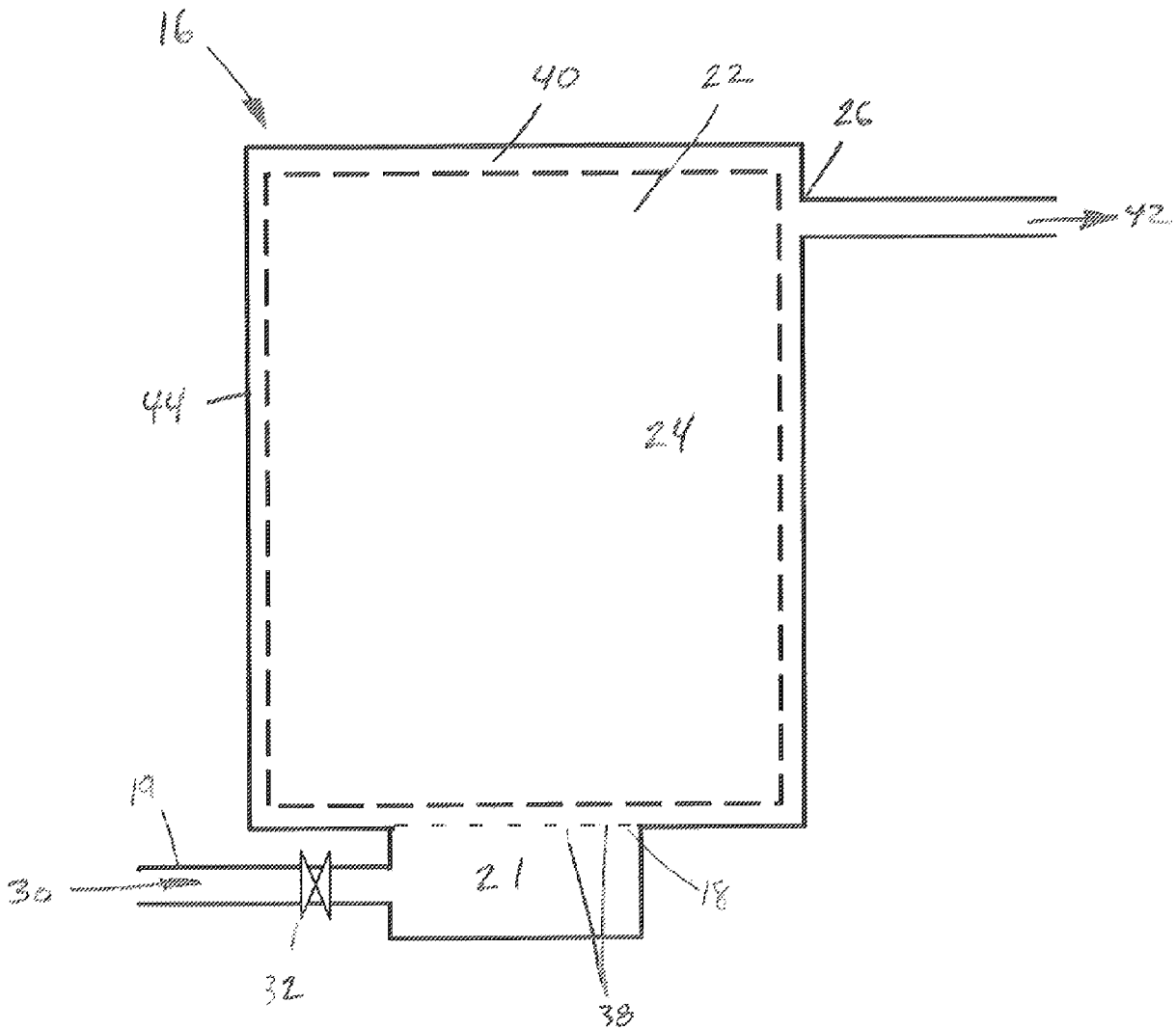
FIG. 4 is a cross-section view of another finishing vessel as described herein.

FIG. 4 show a variation that utilizes a hybrid water trap/diffuser 21 located external to the finishing vessel 16. In this variation, the acetylene feed 30 flows in feed pipe 19 through a one-way valve 32 and into the hybrid water trap/diffuser 21. The interface of the hybrid water trap/diffuser 21 and the finishing vessel 16 can include one or more orifices 38. As with the other arrangements, the orifices 38, the finishing vessel outlet 26, or both 26, 38, can have a smaller diameter than the acetylene feed pipe 19 and/or finishing vessel inlet 18.

As shown in FIG. 5, the acetylene feed pipe 19 can be connected directly to a hybrid water trap/diffuser 21 disposed within the outer housing 44 of the finishing vessel 16. Where the hybrid water trap/diffuser 21 (or a diffuser 20) is positioned on its side, the orifices 30 may be positioned on the upper portion of the hybrid water trap/diffuser 21 so that water does not drip into the bed of solid calcium carbide 24. In this instance, the orifices 28 are located on the upper 75% of the hybrid water trap/diffuser 21.

A method for producing a hydrocarbon-containing mixture is also described. The method can include providing a feed stream comprising acetylene, and reacting the feed stream with solid calcium carbide ($CaC_2$) to produce a hydrocarbon-containing mixture comprising acetylene and butenyne. The hydrocarbon-containing mixture can (i) further comprise dimethyl butadiyne, (ii) comprise at least 10% butenyne, or (iii) both.

The reacting can include reacting the feed stream with particulate calcium carbide, a filter media, or both. The reacting step can also include (a) passing the feed stream through a water trap prior to reacting the feed stream with the solid calcium carbide; (b) pressurizing the feed stream prior to reacting the feed stream with the solid calcium carbide; or (c) both. The pressure of the feed stream during the reacting step can be at least 15 psig (or at least 18 psig, or at least 20 psig), while the pressure of the feed stream prior to the reacting step can be less than 15 psig.

The reacting step can include pressurizing the feed stream prior to reacting the feed stream with the solid calcium carbide. For example, the feed stream 30 can pass through the orifices 38 of the diffuser 20 prior to the reacting step.

The reacting step can be of sufficient duration that the hydrocarbon-containing mixture product stream 42 comprises 10% to 89% acetylene, 10% to 89% butenyne, and at least 1% dimethyl butadiyne. The reacting step can be of sufficient duration that the butenyne-to-acetylene ratio of the product stream 42 containing the hydrocarbon-containing mixture is at least 0.5:1. The reacting step can be of sufficient duration that the product stream 42 comprises at least 20% butenyne. The reacting step can be of sufficient duration that the hydrocarbon-containing mixture in the product stream has any of the compositions described herein.

The foregoing is provided for purposes of illustrating, explaining, an describing embodiments of the method and system. Modifications and adaptations to these embodiments will be apparent to those skilled in the art and may be made without departing from the scope or spirit of this disclosure.

The invention claimed is:

1. A hydrocarbon-containing mixture, comprising acetylene, dimethyl butadiyne, and butenyne.

2. The hydrocarbon-containing mixture according to claim 1, wherein said hydrocarbon-containing mixture comprises:
10% to 89% acetylene,
10% to 89% butenyne, and
at least 0.25% dimethyl butadiyne.

3. The hydrocarbon-containing mixture according to claim 1, wherein a butenyne-to-acetylene ratio is at least 0.5:1.

4. The hydrocarbon-containing mixture according to claim 1, wherein the mixture is stable at a pressure of 25 psig for more than 1 day.

5. The hydrocarbon-containing mixture according to claim 1, comprising at least 20% butenyne.

6. The hydrocarbon-containing mixture according to claim 1, wherein said hydrocarbon-containing mixture is anhydrous.

7. The hydrocarbon-containing mixture according to claim 1, wherein an energy content of said hydrocarbon-containing mixture is at least 1,100 BTU/$ft^3$ at standard temperature and pressure.

8. The hydrocarbon-containing mixture according to claim 1, wherein said hydrocarbon-containing mixture is in liquid form.

9. The hydrocarbon-containing mixture according to claim 1, further comprising at least 1% divinyl sulfide, at least 1% nitrogen, or both.

10. A method for producing a hydrocarbon-containing mixture, comprising:
providing a feed stream comprising acetylene; and
reacting said feed stream with solid calcium carbide ($CaC_2$) to produce a hydrocarbon-containing mixture comprising acetylene, dimethyl butadiyne, and butenyne.

11. The method according to claim 10, wherein said reacting comprises a reacting the feed stream with particulate calcium carbide.

12. The method according to claim 10, wherein said reacting step further comprises pressurizing the feed stream prior to reacting the feed stream with the solid calcium carbide.

13. The method according to claim 10, wherein the reacting step is of a sufficient duration that said hydrocarbon-containing mixture stream comprises:
10% to 89% acetylene,
10% to 89% butenyne, and
at least 1% dimethyl butadiyne.

14. The method according to claim 10, wherein the reacting step is of a sufficient duration that a butenyne-to-acetylene ratio of said hydrocarbon-containing mixture stream is at least 0.5:1.

15. The method according to claim 10, wherein the reacting step is of a sufficient duration that said hydrocarbon-containing mixture stream comprises at least 20% butenyne.

16. The method according to claim 10, wherein the hydrocarbon-containing mixture is anhydrous.

17. The method according to claim 10, wherein said reacting step further comprises:
(i) passing the feed stream through a water trap prior to reacting the feed stream with the solid calcium carbide;
(ii) pressurizing the feed stream prior to reacting the feed stream with the solid calcium carbide; or both.

* * * * *